US007733292B2

(12) United States Patent
Tang et al.

(10) Patent No.: US 7,733,292 B2
(45) Date of Patent: Jun. 8, 2010

(54) FM CHIP ANTENNA

(75) Inventors: Chia-Lun Tang, Pa-Te (TW); Sheng-Hong Wang, Pa-Te (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 44 days.

(21) Appl. No.: 12/113,370

(22) Filed: May 1, 2008

(65) Prior Publication Data

US 2009/0273537 A1 Nov. 5, 2009

(51) Int. Cl.
*H01Q 1/36* (2006.01)

(52) U.S. Cl. ..... 343/895; 343/702

(58) Field of Classification Search ..... 343/702, 343/700 MS, 745, 749, 895
See application file for complete search history.

(56) References Cited

U.S. PATENT DOCUMENTS 6,636,725 B1 * 10/2003 Yoshimoto ..... 455/575.7
7,367,281 B2 * 5/2008 Lee ..... 118/723 AN
2003/0132892 A1 * 7/2003 Yde-Andersen et al. .... 343/895

* cited by examiner

*Primary Examiner*—Tan Ho
(74) *Attorney, Agent, or Firm*—Guice Patents PLLC

(57) ABSTRACT

A frequency modulation (FM) chip antenna having a microwave base board printed thereon with a helical radiation metallic member of a single layer or multiple layers, the microwave base board is provided with a feeding point and a grounding point to receive energy in the mode of electromagnetic wave coupling.

3 Claims, 5 Drawing Sheets

✓ : The antenna of the present invention
× : The original conventional antenna

| Channel (MHz) | Clearly | Acceptable | With Noise | No Signal |
|---|---|---|---|---|
| 88.9 | | ✓× | | |
| 89.1 | | | | ✓× |
| 89.3 | | | ✓× | |
| 89.5 | × | ✓ | | |
| 89.7 | | | | ✓× |
| 89.9 | | | | ✓× |
| 90.1 | | | | ✓× |
| 90.3 | | | | ✓× |
| 90.5 | | | | ✓× |
| 90.7 | | | | ✓× |
| 90.9 | | × | ✓ | |
| 91.1 | ✓× | | | |
| 91.5 | × | ✓ | | |
| 91.7 | | | | ✓× |
| 91.9 | × | ✓ | | |
| 92.1 | | | | ✓× |
| 92.5 | | | | ✓× |
| 92.7 | ✓× | | | |
| 93.1 | | ✓× | | |
| 93.5 | | × | ✓ | |
| 93.7 | | | | ✓× |
| 94.3 | | | ✓× | |
| 96.1 | ✓× | | | |
| 96.3 | ✓× | | | |
| 96.7 | ✓× | | | |
| 97.3 | | × | ✓ | |
| 98.1 | × | ✓ | | |
| 98.3 | | | | ✓× |
| 98.9 | | × | ✓ | |
| 99.3 | × | ✓ | | |
| 99.7 | | × | ✓ | |
| 100.7 | | × | ✓ | |
| 101.5 | ✓× | | | |
| 101.7 | × | ✓ | | |
| 102.5 | × | ✓ | | |
| 103.3 | ✓× | | | |
| 103.9 | | × | ✓ | |
| 104.1 | | × | ✓ | |
| 104.5 | | ✓× | | |
| 104.9 | × | ✓ | | |
| 105.1 | | | | ✓× |
| 105.9 | × | ✓ | | |
| 106.5 | × | ✓ | | |
| 107.1 | ✓× | | | |
| 107.7 | | × | ✓ | |
| 107.9 | | | | ✓× |

FIG. 7

FM CHIP ANTENNA

BACKGROUND OF THE INVENTION

1. Field of the Invention

The present invention relates to an antenna, and especially to a frequency modulation (FM) chip antenna which is characterized by small size and suitable for applicable to a set of portable wireless equipment.

2. Description of the Prior Art

Frequency for frequency modulation (FM) is about 100 MHz, it has a wavelength of 3 m; it is hard to design an actual antenna of such frequency for application to a set of portable wireless equipment limited in volume.

The present invention uses a small loop antenna circuit resonating at this frequency, by a mode of coupling induction between a radio station and sets of portable wireless equipment, energy conversation between two sets of portable wireless equipment can thus be effected.

The present invention uses this principle to design a small size FM antenna suitable for a set of portable wireless equipment.

SUMMARY OF THE INVENTION

The main object of the present invention is to provide a frequency modulation (FM) chip antenna having a microwave base board printed thereon with a helical radiation metallic member of a single layer or multiple layers, and the microwave base board is provided with a feeding point and a grounding point to receive energy in the mode of electromagnetic wave coupling.

The present invention can have the feeding point connected with an adjustable passive element, the resonant band of the antenna can be adjusted within 70~108 MHz by the added adjustable passive element.

The FM chip antenna provided by the present invention can be reduced by size effectively with the design of having the helical radiation metallic member of multiple layers, and can be applied to and built in a portable wireless device.

The present invention will be apparent after reading the detailed description of the preferred embodiment thereof in reference to the accompanying drawings.

BRIEF DESCRIPTION OF THE DRAWINGS

FIG. 7 is a table listing the results obtained by the present invention and the conventional antenna for comparison concerning the effects of receiving various radio stations.

DETAILED DESCRIPTION OF THE PREFERRED EMBODIMENT

Figure 1:
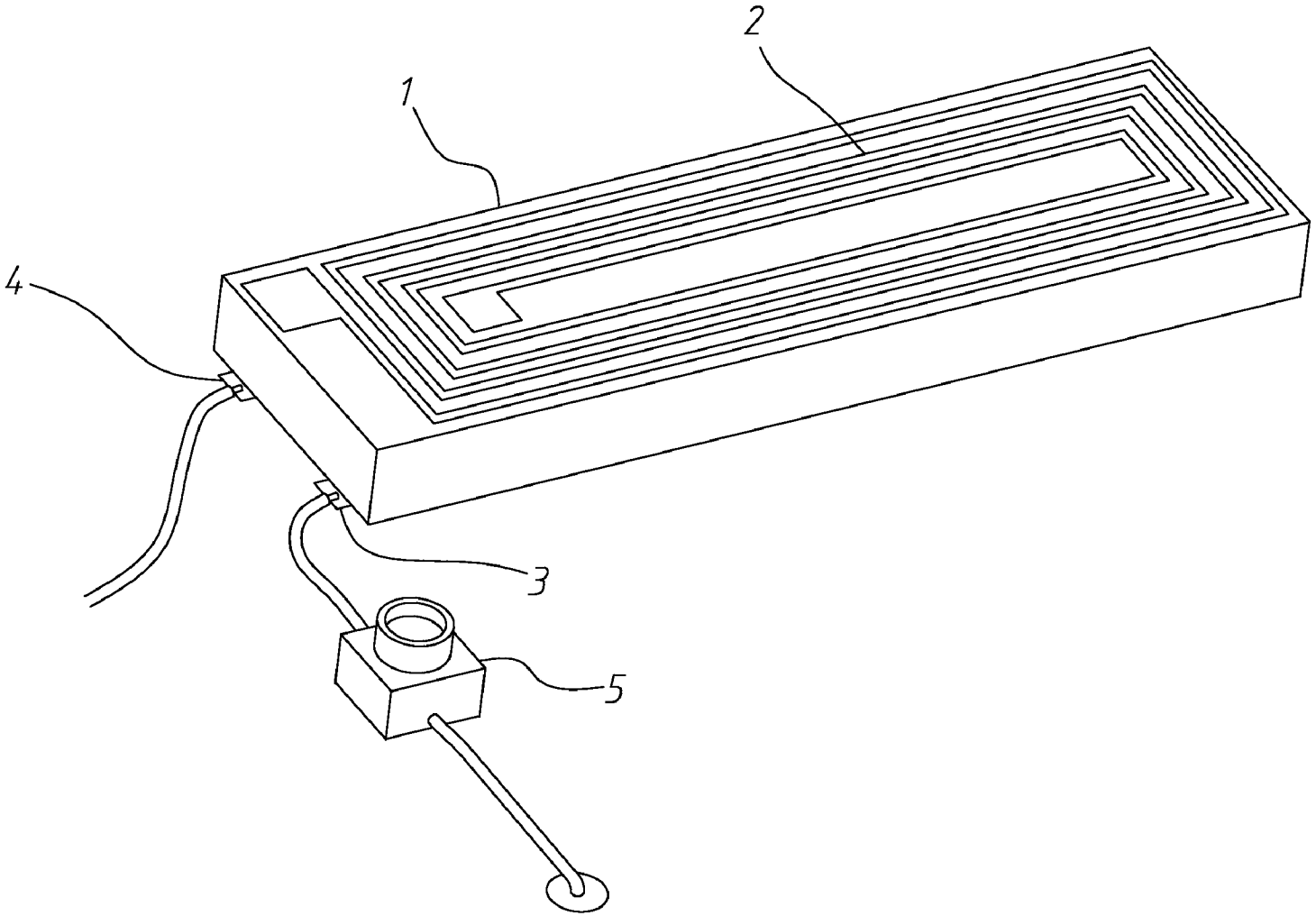
FIG. 1 is a perspective view showing the appearance of an embodiment of the present invention.

Referring to FIG. 1 showing a first embodiment of the present invention, wherein an FM chip antenna provided has a microwave base board 1 printed thereon with a helical radiation metallic member 2, the microwave base board 1 is provided with a feeding point 3 and a grounding point 4 to receive energy in the mode of electromagnetic wave coupling.

Figure 2:
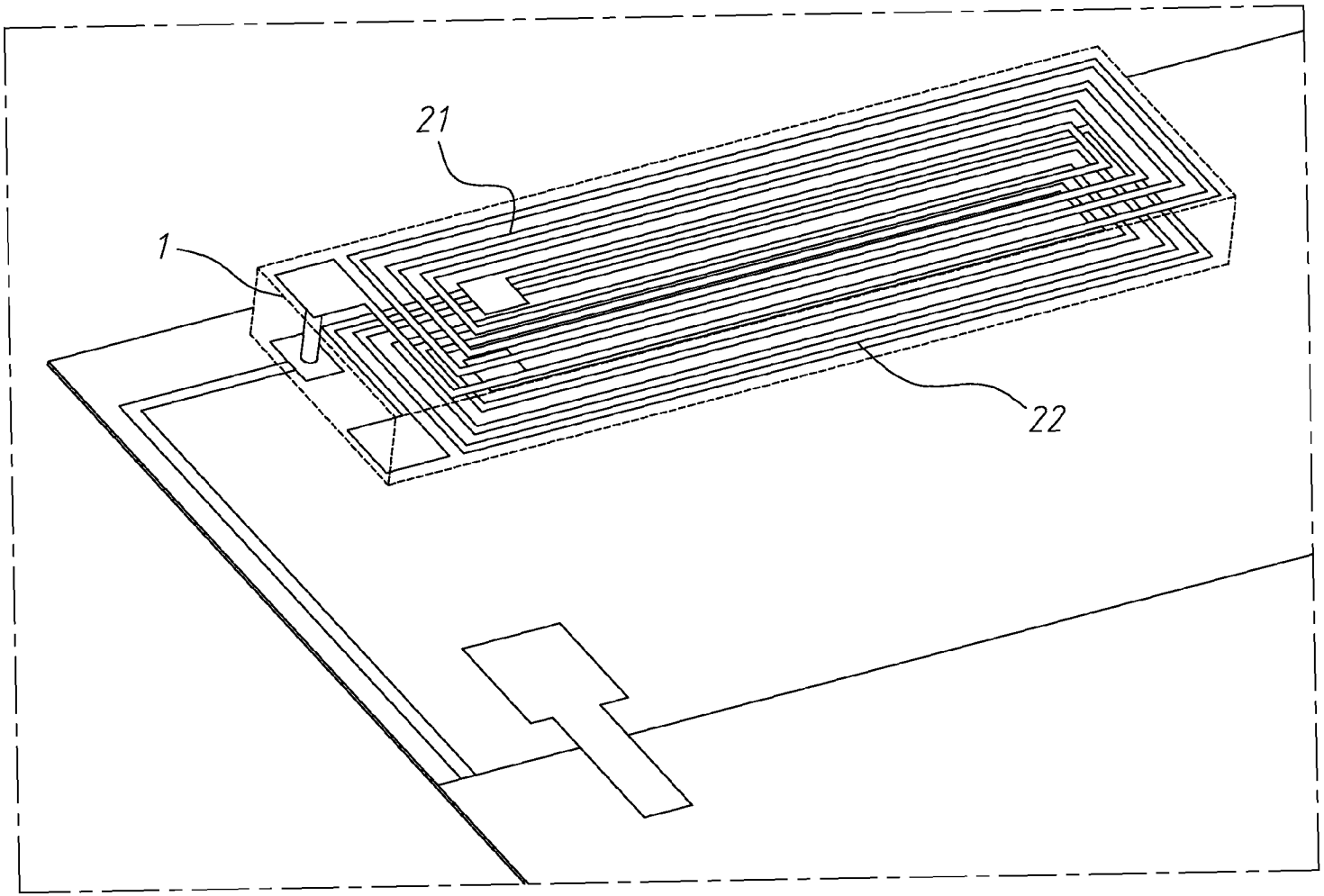
FIG. 2 is a schematic perspective view showing the elements of the present invention.

The helical radiation metallic member 2 of the present invention provided on the microwave base board 1 is of a single layer or multiple layers. Referring to FIG. 2 which is schematic perspective view of the present invention, we can see that the present invention is printed on its top outside and bottom outside surfaces of the microwave base board 1 respectively with lower and upper helical radiation metallic members 21, 22, and provided with a hole to electrically connect the upper helical radiation metallic member 21 with the lower helical radiation metallic member 22, both the upper and the lower helical radiation metallic members 21, 22 are composed of the helical radiation metallic member 2.

The material of the microwave base board 1 is FR4, ceramic etc. And the present invention is connected at the feeding point 3 with an adjustable passive element 5, the resonant band of the antenna can be adjusted within 70~108 MHz by the added adjustable passive element 5.

The size of the FM chip antenna provided by the present invention in this embodiment is 18.5×5.5×1.5 ($mm^3$), and has a capacitor value of 3~10 pF.

The FM chip antenna is provided on a test board which has a size of 105×43×1 ($mm^3$), the distance from the antenna to the ground surface is 1~8 mm.

Figure 4:
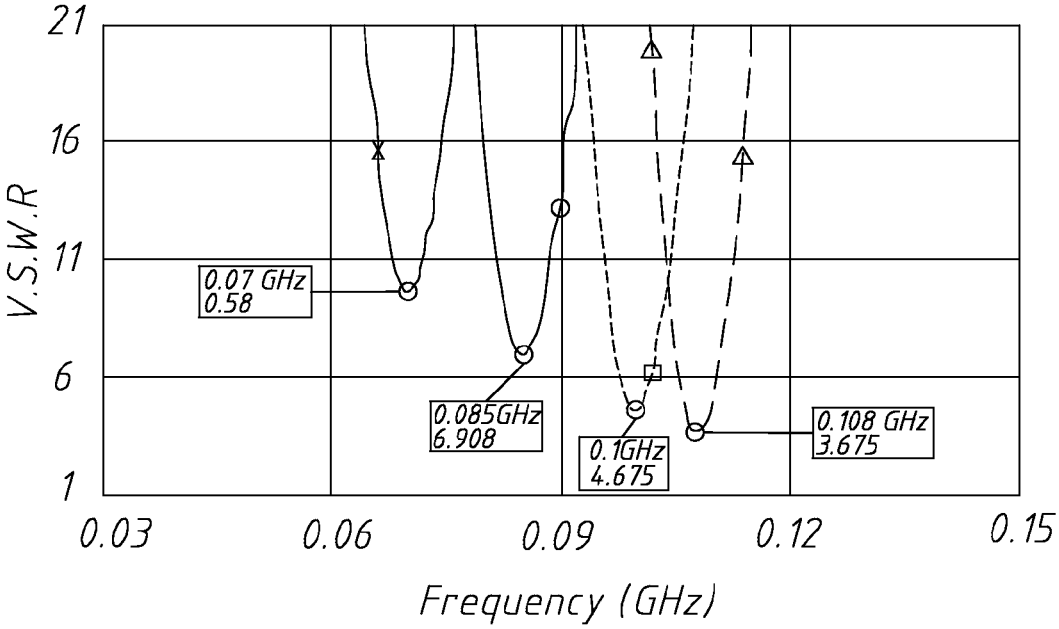
FIG. 4 shows the result of a simulated standing wave ratio test of the present invention.
Figure 3:
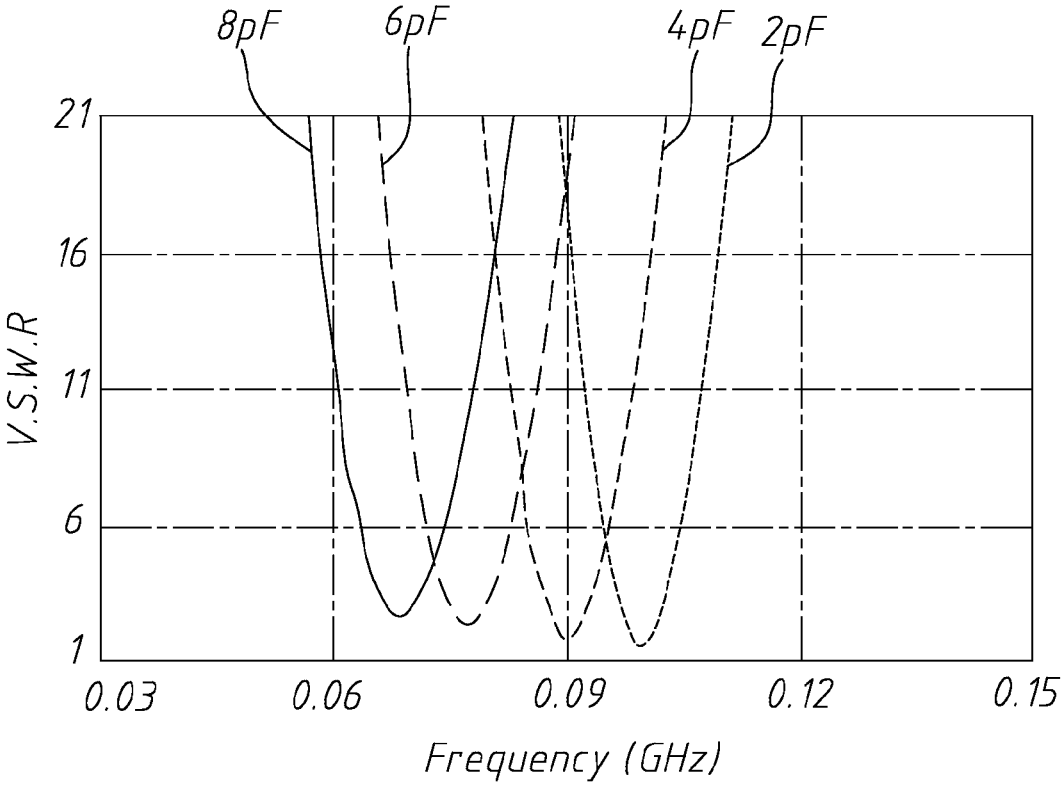
FIG. 3 shows the result of a standing wave ratio test of the present invention.

FIG. 3 shows the result of a standing wave ratio test of the present invention, we can see from the drawing that by rotating a variable capacitor, the resonant band of the antenna can be adjusted from 70 to 108 MHz. FIG. 4 shows the result of a simulated standing wave ratio test of the present invention, in which the capacitor value is increased from 2 pF to 8 pF, and the resonant frequencies of every different capacitor value is as follows:

2 pF is 113 MHz
4 pF is 89 MHz
6 pF is 77 MHz
8 pF is 68 MHz

The test of FIG. 3 has the approximate result as that of the simulated standing wave ratio test; so that a tool for simulation can be preferentially used to design the shape and capacitor value of the antenna.

Figure 6:
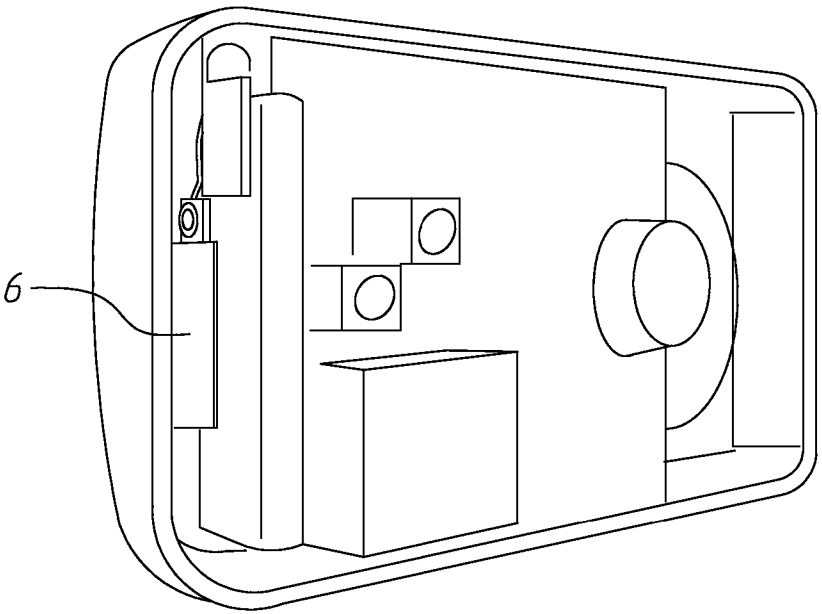
FIG. 6 is a perspective view showing an antenna of the present invention is placed in the radio of FIG. 5.
Figure 5:
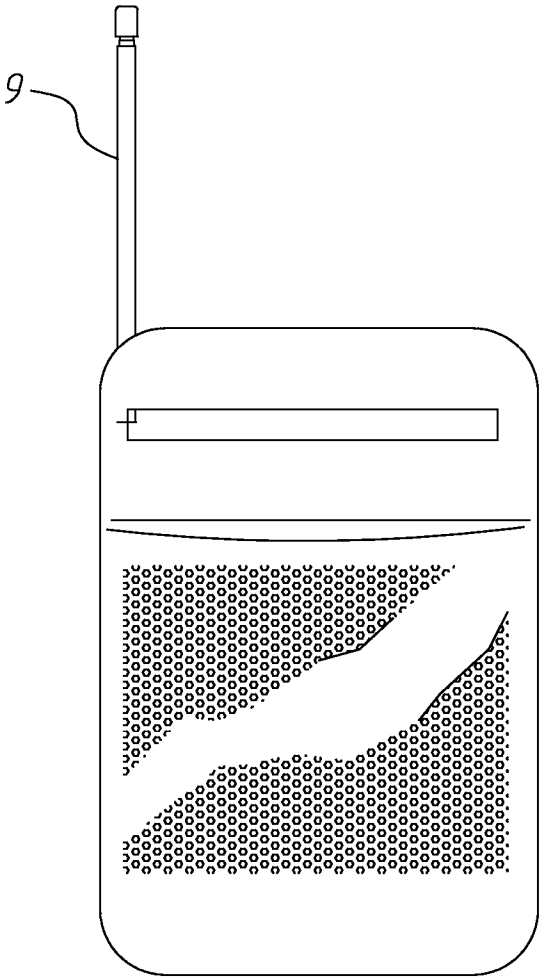
FIG. 5 is a plane view showing a kind of Panasonic radio actually sold in the markets.

FIG. 5 shows a kind of Panasonic radio actually sold in the markets; in which a monopole antenna 9 is used originally. FIG. 6 shows an antenna 6 of the present invention is placed in the same radio for comparison; as shown in FIG. 7, the results obtained by the two antennas concerning the effects of receiving various radio stations are compared. Thereby it can prove that the FM chip antenna provided for the present invention can be reduced by size effectively with the design of having the helical radiation metallic member of multiple layers, and can be applied to and built in a portable wireless device.

Therefore, the antenna of the present invention has a high industrial application value and thus meets the condition of inventiveness. Having now particularly described and ascertained the novelty and improvement of my invention and in what manner the same is to be performed, what we claim will be declared in the claims followed.

The invention claimed is:

1. A frequency modulation (FM) chip antenna comprising:

a microwave base board having a feeding point and a grounding point;

a helical radiation metallic member having multiple layers printed on said microwave base board and receiving energy in a mode of electromagnetic wave coupling, said multiple layers of said helical radiation metallic member being electrically connected through a hole located in the microwave base board; and an adjustable passive element connected with said feeding point and selectively adjusting a resonant band of said antenna in a range from 70 MHz to 108 MHz.

2. The frequency modulation (FM) chip antenna as defined in claim 1, wherein said antenna is applied to and built in a portable wireless device.

3. The frequency modulation (FM) chip antenna as defined in claim 1, wherein said microwave base board has a size of 18.5 mm×5.5 mm×1.5 mm, a capacitor value of said frequency modulation (FM) chip antenna is in a range from 3 pF to 10 pF.

* * * * *